US006157130A

United States Patent [19]

Omori et al.

[11] Patent Number: 6,157,130

[45] Date of Patent: Dec. 5, 2000

[54] METAL HALIDE LAMP WITH SPECIFIC INTERNAL ELECTRODE SEAL DETAIL

[75] Inventors: Shinya Omori, Yokohama; Takashi Futami, Tokyo; Yasuhisa Yaguchi, Sagamihara; Masaaki Muto, Kawasaki, all of Japan

[73] Assignee: Stanley Electric Co., Ltd., Tokyo, Japan

[21] Appl. No.: 09/081,683

[22] Filed: May 20, 1998

[30] Foreign Application Priority Data

May 23, 1997 [JP] Japan ..... 9-133798

[51] Int. Cl.[7] ..... H01J 17/16; H01J 61/30

[52] U.S. Cl. ..... 313/634; 313/567

[58] Field of Search ..... 313/567, 570, 313/571, 573, 580, 620, 623, 634, 639

[56] References Cited

U.S. PATENT DOCUMENTS

| | | | |
|---|---|---|---|
| 4,221,989 | 9/1980 | Van Lieshout | 313/331 |
| 4,594,529 | 6/1986 | de Vrijer | 313/571 |
| 4,992,700 | 2/1991 | Lake | 313/639 |
| 5,043,634 | 8/1991 | Rothwell, Jr. et al. | 315/246 |
| 5,077,505 | 12/1991 | Ekkelboom et al. | 313/623 |
| 5,525,863 | 6/1996 | Kowalczyk et al. | 313/634 |
| 5,714,839 | 2/1998 | Chao | 313/571 |

*Primary Examiner*—Ashok Patel
*Assistant Examiner*—Matthew J. Gerike
*Attorney, Agent, or Firm*—Morgan, Lewis & Bockius LLP

[57] ABSTRACT

A high pressure discharge lamp used as a light source for an automobile headlight and a method of forming the high pressure discharge lamp are disclosed. The high pressure discharge lamp includes a discharge chamber portion defining a discharge chamber filled with metal halide and rare gas, a pair of opposing electrodes, a portion of each electrode respectively projecting a predetermined distance into the discharge chamber, molybdenum foils, lead wires, and a bulb. The bulb includes a tapered portion, a sealed portion, and a sealed end having portions of a molybdenum foil, an electrode, and a lead wire disposed therein.

17 Claims, 1 Drawing Sheet

METAL HALIDE LAMP WITH SPECIFIC INTERNAL ELECTRODE SEAL DETAIL

RIGHT OF PRIORITY

This invention claims the benefit of Japanese Patent Application No. HEI 09-133798, filed on May 23, 1997.

BACKGROUND OF THE INVENTION

1. Field of the Invention

This invention relates to a high pressure discharge lamp, and more particularly, to an apparatus and a method of producing a high pressure discharge lamp that is used as a light source in an automobile headlight or a fog light.

2. Discussion of the Related Art

A horizontal cross sectional view of a conventional high pressure discharge lamp is shown in FIG. 3. The high pressure discharge lamp may be used in an automobile headlight. The high pressure discharge lamp 90 comprises a bulb 91 having a center portion 91*a* defining a discharge chamber filled with rare gas and metal halide, sealed portions 91*c*, and sealed ends 91*b*. The sealed ends 91*b* include a pair of electrodes 92 projecting a predetermined distance into the discharge chamber, molybdenum foils 93, and lead wires 94.

A conventional method to form the discharge chamber of the bulb 91 comprises the steps of providing a pipe, heating and softening its center portion 91*a*, and blowing air into the pipe so that the center portion 91*a* expands to be substantially barrel-shaped. In an actual application, an outer bulb and a socket are created as well, although the composition and steps are not discussed herein.

The conventional high pressure discharge lamp 90 has the following problems. First, the curvature of the surface between the center portion 91*a* and the sealed ends 91*b* greatly changes at the sealed portions 91*c*. Accordingly, during operation of the automobile headlight, spot-shaped glare light is emitted from the sealed portion 91*c* due to the curvature of the surface. This glare light creates the appearance that the headlight has two or more light sources. Second, since the curved surface of the discharge chamber, corresponding to the center portion 91*a*, is formed by blowing air into the pipe, it is difficult to mass produce bulbs with uniform dimensions. Finally, since the diameter of the discharge chamber is the largest around the center of the arc A, the arc A is prone to curvature, which causes an unfavorable light distribution pattern change over time.

SUMMARY OF THE INVENTION

The present invention is directed to a high pressure discharge lamp for automobiles that substantially obviates one or more of the above problems due to the limitations and disadvantages of the conventional lamps.

An object of the invention is to provide a high pressure discharge lamp for automobiles with improved light distribution patterns.

Another object of the invention is to provide a high pressure discharge lamp for automobiles that enables increased efficiency when used as a light source for an automobile headlight.

A further object of the invention is to provide a high pressure discharge lamp that does not have a great change in curvature of its bulb surface that would create a spot-shaped glare light.

A still further object of the invention is to provide a method to mass produce high pressure discharge lamps with the above improved properties and facilitate quality control in the production.

According to the present invention, the above objects are achieved by providing a high pressure discharge lamp comprising a substantially cylindrically shaped discharge chamber whose horizontal length is larger than the distance between the opposing electrode ends projecting into the discharge chamber. The lamp also comprises tapered portions formed on the sealed ends of the bulb. The tapered portions taper either along or perpendicular to the longitudinal axis of the high pressure discharge lamp towards the discharge chamber.

BRIEF DESCRIPTION OF THE DRAWINGS

The accompanying drawings, which are included to provide a further understanding of the invention, illustrate embodiments of the invention and together with the description serve to the principles of the invention.

DETAILED DESCRIPTION OF THE PREFERRED EMBODIMENTS

Figure 1:
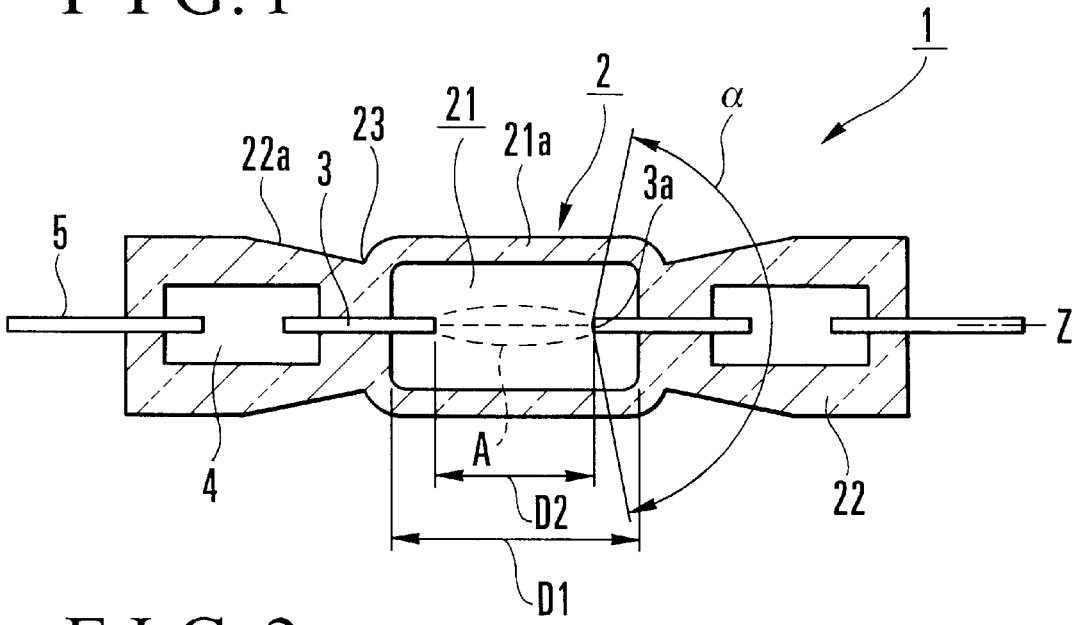
FIG. 1 is a cross sectional view of a high pressure discharge lamp according to a first preferred embodiment of the present invention.

The first preferred embodiment of a high pressure discharge lamp 1 for an automobile is shown in FIG. 1. The automotive high pressure discharge lamp 1 comprises a discharge chamber 21 filled with metal halide and rare gas, a pair of opposing electrodes 3, molybdenum foils 4, lead wires 5, and a bulb 2. A portion of each electrode 3 projects a predetermined distance into the discharge chamber 21. The bulb 2 comprises a discharge chamber portion 21*a* defining and surrounding the discharge chamber 21, tapered portions 22*a* tapering towards the discharge chamber 21, sealed ends 22, and sealed portions 23. Preferably, the discharge chamber portion 21*a* is either a rectangularly shaped box, a cube, or a circular cylinder.

The passage of the emitted light through the bulb is very complicated. It is difficult to predict how and in which direction the passage of the emitted light will change due to the characteristics of the bulb. In the first preferred embodiment of this invention, the horizontal length D1 of the discharge chamber portion 21*a* is larger than the distance D2 between the opposing ends 3*a* of electrodes 3, as shown in FIG. 1. The difference in length between D1 and D2 permits light emitted from arc A to pass through the discharge chamber portion 21*a* without any substantial change in the light passage.

According to tests and experiments performed by the inventors, each end of the discharge chamber portion 21*a* should exist respectively within a cone as shown in FIG. 1. As shown, each cone flares from a projecting end 3*a* of an electrode 3 towards a sealed end 22 and has an apical angle . Preferably, the apical angle is 160 degrees and the cone is centered on the projecting end 3*a*. However, the apical angle may be any appropriate value that permits the light to pass without any substantial change. As long as the ends of the discharge chamber portion 21*a* exist within the above described cones, the passage of emitted light does not substantially change. Thus, several methods of forming the sealed portions 23 will achieve the desired result, including pinch-sealing or tapering.

Turning to a method to produce the high pressure discharge lamp 1, the discharge chamber 21 is formed from a pipe into a rectangularly shaped box, a cube, or a circular cylinder. While the pipe is preferably silica glass, any suitable material may be used. According to the present invention, the step of heating and blowing air into the pipe to expand discharge chamber portion 21*a* to be substantially barrel-shaped is not required. The sealed portions 23 and tapered portions 22*a* are formed while the electrodes 3, molybdenum foils 4, and lead wires 5 are disposed into the sealed ends 22.

The portion of the pipe corresponding to each sealed end 22 is heated, melted, and molded using dies having predetermined shapes to form a tapered portion 22*a* and a sealed portion 23. The tapered portions 22*a* are arranged so that the bulb 2 does not have a large curvature change along its surface at the sealed portions 23. The direction of the tapering of the tapered portions 22*a* may be along the longitudinal axis of the high pressure discharge lamp 1, perpendicular to the longitudinal axis, or in both directions.

The operational advantages of high pressure discharge lamp 1 will now be described. First, since the emitted light from the arc A substantially passes through a predetermined area, specifically the discharge chamber portion 21*a*, and radiates outside of the high pressure discharge lamp 1, mass production of high pressure discharge lamps with uniform light distribution patterns is facilitated. Second, since the steps of heating and blowing air into the pipe at its center portion to expand the discharge chamber 21 are not required, the diameter of the discharge chamber 21 is smaller than those of conventional lamps.

Figure 3:
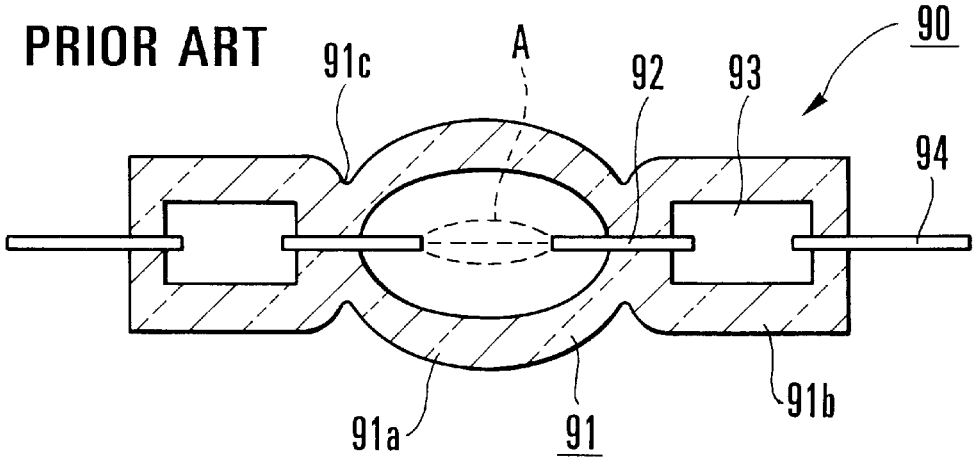
FIG. 3 PRIOR ART
FIG. 3 is a cross sectional view of a conventional high pressure discharge lamp.

As a result of the smaller diameter, the curvature of the arc A decreases, thereby providing more stabilized light distribution patterns. This advantage is evident when the high pressure discharge lamp 1 is used as a light source in an automobile headlight. The shadow of the light source on the reflector moves a smaller distance than in a conventional lamp. Finally, the surfaces of the sealed portions 23 do not have a large curvature change that would cause irregular light refraction, spot-shaped glare light, or stray light at the sealed portions 23. Referring to FIG. 1, each sealed portion 23 is shown with a relatively smooth and continuous surface between the discharge chamber portion 21*a* and a sealed end 22 as compared to the same location as the conventional lamp shown in FIG. 3.

Figure 2:
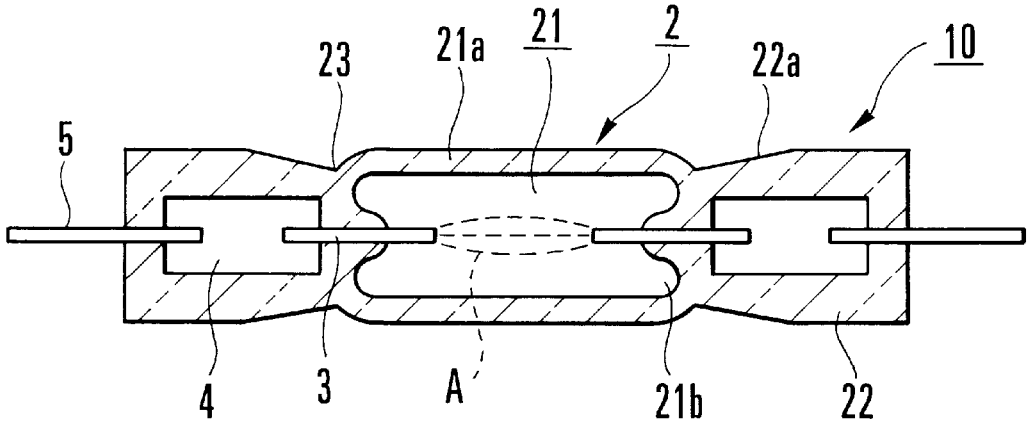
FIG. 2 is a cross sectional view of a high pressure discharge lamp according to a second preferred embodiment of the present invention.

A second preferred embodiment of the high pressure discharge lamp 10 is shown in FIG. 2. In this embodiment, once the tapered portion 22*a* and the sealed portion 23 are formed, the sealed end 22 is pushed towards the discharge chamber 21 so that a portion of the sealed end 22 extends into the discharge chamber 21 to form a pocket portion 21*b*. The pocket portion 21*b* surrounds the extending portion of the sealed end 22. The pocket portion 21*b* may be formed at one end or both ends of the discharge chamber 21.

A certain quantity of the metal halide in the discharge chamber 21 does not evaporate in the operation of the high pressure discharge lamp 10. A property of metal halide is that it moves towards a lower temperature area. In the conventional automotive high pressure discharge lamp 90, the non-evaporated metal halide remains around the lower portion in the discharge chamber. The metal halide exists on the light passageway towards the outside of the automobile headlight. As a result, the light passing through the non-evaporated metal halide is unfavorably colored. Accordingly, the quality of the automobile headlight is deteriorated. In the conventional high pressure discharge lamp 90, a shade is required to prevent the light passing through the lower portion of the discharge chamber from radiating outside of the automobile headlight.

On the other hand, in the second preferred embodiment of the present invention, the non-evaporated metal halide stays around a pocket portion 21*b*, which has the lowest temperature in the discharge chamber 21 during the operation of the high pressure discharge lamp 10. A pocket portion 21*b* is located outside the light passageway from the arc A, thereby preventing the emitted light from being colored unfavorably. Thus, a shade is not required, and nearly all the light emitted from the arc A is used as a light source for the automobile headlight. As a result, the lumen output and power consumption efficiency of the automobile headlight are greatly improved.

It will be apparent to those skilled in the art that various modifications and variations can be made in the high pressure discharge lamp of the present invention without departing from the spirit or scope of the invention. It is intended that the present invention cover the modifications and variations of this invention provided they come within the scope and spirit of the appended claims and their equivalents.

What is claimed is:

1. A high pressure discharge lamp for an automobile, the lamp comprising a discharge chamber portion defining a discharge chamber filled with metal halide and rare gas, molybdenum foils, lead wires, a bulb, and a pair of opposing electrodes, each electrode including a portion projecting a predetermined distance into the discharge chamber, the bulb comprising:

tapered portions tapering towards the discharge chamber;

sealed ends, each sealed end having portions of a molybdenum foil, an electrode, and a lead wire disposed therein; and sealed portions, each sealed portion having a relatively smooth and continuous surface between the discharge chamber and a sealed end, and said tapered portions being positioned in the sealed portions, wherein the discharge chamber portion has a length greater than the distance between ends of the projecting portions of the electrodes in the discharge chamber and has an outer diameter that is constant along said length.

2. The high pressure discharge lamp of claim 1, wherein the discharge chamber portion is a rectangularly shaped box, a cube, or a circular cylinder.

3. The high pressure discharge lamp of claim 1, wherein each end of the discharge chamber exists respectively within a cone having its center on an electrode end in the discharge chamber and flaring towards a sealed end, the cone having an apical angle of approximately 160 degrees.

4. The high pressure discharge lamp of claim 3, wherein at least one of the sealed ends includes a portion extending into the discharge chamber, and the bulb further comprises a pocket portion surrounding at least part of the extending portion of at least one of the sealed ends.

5. The high pressure discharge lamp of claim 1, wherein the direction of the tapering is along a longitudinal axis of the lamp.

6. A high pressure discharge lamp for an automobile, the lamp comprising a discharge chamber portion defining a discharge chamber filled with metal halide and rare gas, molybdenum foils, lead wires, a bulb, and a pair of opposing electrodes, each electrode including a portion projecting a predetermined distance into the discharge chamber, the bulb comprising:

sealed ends, each sealed end having portions of a molybdenum foil, an electrode, and a lead wire disposed therein, pinch-sealed portions, each sealed portion having a relatively smooth and continuous surface between the discharge chamber and a sealed end; and tapered portions tapering towards the discharge chamber and positioned in said pinch-sealed portions, wherein the discharge chamber portion has a length greater than the distance between ends of the projecting portions of the electrodes in the discharge chamber and has an outer diameter that is constant along said length.

7. The high pressure discharge lamp of claim 6, wherein the discharge chamber portion is a rectangularly shaped box, a cube, or a circular cylinder.

8. The high pressure discharge lamp of claim 7, wherein at least one of the sealed ends includes a portion extending into the discharge chamber, and the bulb further comprises a pocket portion surrounding at least part of the extending portion of at least one of the sealed ends.

9. The high pressure discharge lamp of claim 6, wherein each end of the discharge chamber exists respectively within a cone having its center on an electrode end in the discharge chamber and flaring towards a sealed end, the cone having an apical angle of approximately 160 degrees.

10. The high pressure discharge lamp of claim 6, wherein the bulb further comprises tapered portions that taper along a longitudinal axis of the lamp toward the discharge chamber, perpendicular to the longitudinal axis, or in both directions.

11. A high pressure discharge lamp for an automobile, the lamp comprising a discharge chamber portion defining a discharge chamber filled with metal halide and rare gas, molybdenum foils, lead wires, a bulb, and a pair of opposing electrodes, each electrode including a portion projecting a predetermined distance into the discharge chamber, the bulb comprising:

a discharge chamber having a constant outer diameter along substantially an entire length of said discharge chamber;

tapered portions tapering towards the discharge chamber;

sealed ends, each sealed end having portions of a molybdenum foil, an electrode, and a lead wire disposed therein, at least one of the sealed ends including a portion extending into the discharge chamber;

a pocket portion surrounding at least part of the extending portion of at least one of the sealed ends; and sealed portions, each sealed portion having a relatively smooth and continuous surface between the discharge chamber and a sealed end, and said tapered portions being positioned in the sealed portions.

12. The high pressure discharge lamp of claim 11, wherein the discharge chamber portion is a rectangularly shaped box, a cube, or a circular cylinder.

13. The high pressure discharge lamp of claim 11, wherein each end of the discharge chamber exists respectively within a cone having its center on an electrode end in the discharge chamber and flaring towards a sealed end, the cone having an apical angle of approximately 160 degrees.

14. The high pressure discharge lamp of claim 11, wherein the discharge chamber portion has a length greater than a distance between the electrode ends in the discharge chamber.

15. The high pressure discharge lamp of claim 11, wherein the tapering direction is along a longitudinal axis of the lamp.

16. A method for producing a high pressure discharge lamp having a discharge chamber portion defining a discharge chamber, molybdenum foils, lead wires, a pair of opposing electrodes, each electrode including a portion projecting a predetermined distance into the discharge chamber, the discharge chamber portion having a length greater than a distance between ends of the projecting portions of the electrodes in the discharge chamber, tapered portions, sealed ends, and sealed portions having a relatively smooth surface between each discharge chamber and sealed end, the method comprising the steps of:

providing a pipe composed of silica glass;

disposing electrodes, molybdenum foils, and lead wires in predetermined positions within the pipe;

heating and melting the portions of the pipe corresponding to the sealed ends; and molding the pipe with dies having predetermined shapes to form the tapered portions and the sealed portions.

17. A method for producing a high pressure discharge lamp having a discharge chamber portion defining a discharge chamber, molybdenum foils, lead wires, a pair of opposing electrodes, each electrode including a portion projecting a predetermined distance into the discharge chamber, tapered portions, sealed ends, and a pocket portion surrounding a part of a sealed end that extends into the discharge chamber, the method comprising the steps of:

providing a pipe composed of silica glass;

disposing electrodes, molybdenum foils, and lead wires in predetermined positions within the pipe;

heating and melting the portions of the pipe corresponding to the sealed ends;

molding the pipe with dies which together form a cavity having a predetermined shape to form the tapered portions and the sealed portions; and pushing at least one sealed end into the discharge chamber to form a pocket portion.

* * * * *